US005081378A

United States Patent [19]

Watanabe

[11] Patent Number: 5,081,378

[45] Date of Patent: Jan. 14, 1992

[54] LOGARITHMIC AMPLIFIER

[75] Inventor: Shuji Watanabe, Kawasaki, Japan

[73] Assignee: Kabushiki Kaisha Toshiba, Kanagawa, Japan

[21] Appl. No.: 642,923

[22] Filed: Jan. 18, 1991

[30] Foreign Application Priority Data

Jan. 19, 1990 [JP] Japan ..... 2-9563

[51] Int. Cl.[5] ..... G06G 7/24

[52] U.S. Cl. ..... 307/492; 307/491; 328/145

[58] Field of Search ..... 307/491, 492, 310; 328/145

[56] References Cited

U.S. PATENT DOCUMENTS 4,786,970 11/1988 Moore ..... 307/492 X

*Primary Examiner*—James B. Mullins

*Attorney, Agent, or Firm*—Banner, Birch, McKie & Beckett

[57] ABSTRACT

An input signal voltage applied to a signal input terminal is converted to a current by a differential amplifier, a voltage-to-current conversion resistor and an NPN type bipolar transistor. An input-impedance determining resistor is connected between the noninverting input terminal of the differential amplifier and ground. An NPN type bipolar transistor, whose collector is shunted to its base, has its collector connected to a constant current source and its emitter connected to a constant voltage source. The base of the NPN transistor is connected to the base of an NPN type bipolar transistor. The emitter of the transistor is connected to the collector of the transistor. A signal output terminal is connected to a connection point of the collector of the transistor and the emitter of the transistor.

11 Claims, 4 Drawing Sheets

LOGARITHMIC AMPLIFIER

BACKGROUND OF THE INVENTION

1. Field of the Invention

The present invention relates to a logarithmic amplifier and, more particularly, to a logarithmic amplifier which is easy in level shift and temperature compensation and adapted for integrated-circuit version.

2. Description of the Related Art

FIG. 1 illustrates a conventional logarithmic amplifier. In the figure, 11 denotes an input signal terminal, 12 denotes a resistor for voltage-to-current conversion, 13 denotes an differential amplifier, 14 denotes a diode and 15 denotes an output signal terminal. The voltage-to-current conversion resistor 12 is connected between the input signal terminal 11 and the inverting input terminal of the differential amplifier 13. The anode and cathode of the diode 14 are connected to the inverting input terminal and the output terminal, respectively, of the differential amplifier 13. The noninverting input terminal of the differential amplifier 13 is connected to ground GND and the output terminal of the differential amplifier 13 is connected to the output signal terminal 15.

FIG. 2 shows another conventional logarithmic amplifier. In this logarithmic amplifier, a circuit composed of a diode 16, an differential amplifier 17, resistors 18 and 19 and a constant current source 20 is connected between the output terminal of the differential amplifier 13 and the output signal terminal 15 of FIG. 1. That is, to the output terminal of the differential amplifier 13 is connected the cathode of the diode 16, the anode of which is connected to the noninverting input terminal of the differential amplifier 17. The inverting input terminal of the differential amplifier 17 is connected to ground potential through the resistor 18 and to its output terminal through the resistor 19. The constant current source 20 is connected between a supply voltage VCC and the noninverting input terminal of the differential amplifier 17.

In the logarithmic amplifier of FIG. 1, the potential at the inverting input terminal of the differential amplifier is brought to ground potential by means of its feedback action, and an input voltage Vin at the input signal terminal 11 is converted a current input by the resistor 12. The resulting current flows in the diode 14 so that a forward voltage VF1 is produced across the diode. The voltage is output from the output signal terminal as a logarithmically compressed output voltage Vol. The output voltage Vol is obtained with respect to ground potential as with the input voltage Vin and given by $$\begin{aligned} Vo1 &= -VF1 = -\frac{kT}{q}\cdot\ln\frac{Vin}{Is1\cdot R1} \\ &= -\frac{kT}{q}(\ln Vin - \ln Is1\cdot R1) \end{aligned} \tag{1}$$

where q = electronic charge k = Boltzmann constant

T = absolute temperature

Is1 = saturation current of the diode 14

R1 = resistance of the resistor 12

As can be seen from equation (1), the conventional logarithmic amplifier of FIG. 1 suffers from poor temperature-characteristic problems because the output voltage Vol varies with temperature due to a coefficient kT/q and Is1 has great temperature dependence.

In the logarithmic amplifier of FIG. 2, a voltage which is higher than the output voltage Vol of the differential amplifier 13 by the forward voltage VF2 across the diode 16 is amplified by the differential amplifier 17 to produce an output voltage Vo2 at its output terminal. In this case, the current flowing through the diode 16 is a constant current Io from the constant current source 20. Thus, the output voltage Vo2 of the differential amplifier 17 is given by $$\begin{aligned} Vo2 &= \frac{R2+R3}{R2}(Vo1 + VF2) \\ &= \frac{R2+R3}{R2}\left(-\frac{kT}{q}\cdot\ln\frac{Vin}{Is1\cdot R1} + \frac{kT}{q}\cdot\ln\frac{Io}{Is2}\right) \\ &= -\frac{R2+R3}{R2}\cdot\frac{kT}{q}(\ln Vin - \ln R1 - \ln Io) \end{aligned} \tag{2}$$

where R1, R2 and R3 are values of the resistors 12, 18 and 19, respectively, and Is1 = Is2.

Assuming here that and the resistors 18 and 19 have different temperature coefficients, the temperature dependence due to the coefficient kT/q is canceled out.

In this case as well, however, the output voltage Vo2 is obtained with respect to ground potential as with the input voltage Vin. For this reason, in order to shift the level of the voltage Vo2 and change the reference potential of the output voltage Vo2, a temperature-compensated complex level shift circuit will be needed. In addition, since the input impedance of the logarithmic amplifier is determined by the resistance of the voltage-to-current conversion resistor 12, a free choice of an input impedance and a high-impedance version thereof are impossible.

SUMMARY OF THE INVENTION

As described above, the conventional logarithmic amplifiers have a problem of poor temperature characteristics. Other problems with the conventional logarithmic amplifiers are that a temperature-compensated complex level shift circuit is needed to shift the level of an output voltage or change a reference potential of the output voltage and a free choice of an input impedance and a high-impedance version thereof are impossible.

It is therefore an object of the present invention to provide a logarithmic amplifier which, with a simple circuit arrangement, permits a level-shift function to be realized, temperature characteristics to be improved and a free choice of an input impedance and a high-impedance version thereof to be realized.

It is the other object of the present invention to provide a logarithmic amplifier which is temperature-compensated, permits level shift to be performed freely and is adapted for integrated-circuit version.

According to the present invention, there is provided a logarithmic amplifier comprising: a signal input terminal; a signal output terminal; a differential amplifier having an inverting input terminal, a noninverting input terminal and an output terminal, said noninverting input terminal being connected to said signal input terminal; a first resistor connected between said noninverting input terminal of said differential amplifier and ground; a second resistor connected between said inverting input terminal of said differential amplifier and ground; a first transistor having a control electrode and a current path, said control electrode being connected to said output terminal of said differential amplifier, one end of said current path being connected to said inverting input terminal of said differential amplifier and the other end of said current path being connected to said signal output terminal; a second transistor having a collector, an emitter and a base, said collector being shunted to said base; a reference voltage source connected to said emitter of said second transistor; a constant current source connected to said collector of said second transistor; and a third transistor having its collector connected to a supply voltage, its base connected to said base of said second transistor and its emitter connected to said signal output terminal, said third transistor being of the same polarity as said second transistor.

DETAILED DESCRIPTION OF THE PREFERRED EMBODIMENTS

Figure 1:
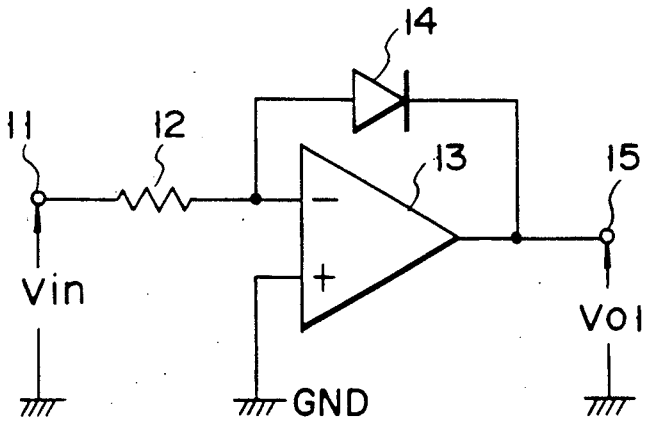
FIG. 1 (PRIOR ART)
FIG. 1 is a circuit diagram of a conventional logarithmic amplifier.
Figure 2:
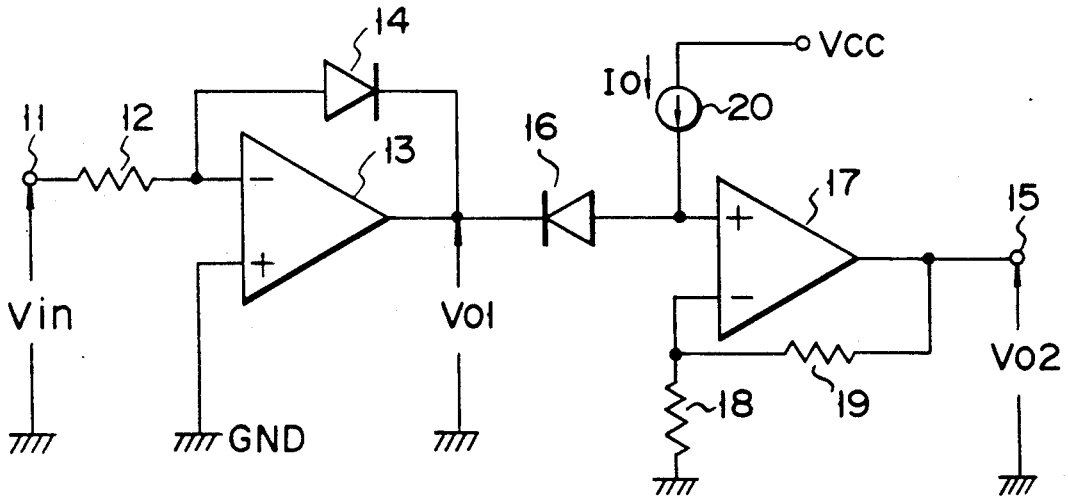
FIG. 2 (PRIOR ART)
FIG. 2 is a circuit diagram of another conventional logarithmic amplifier.
Figure 3:
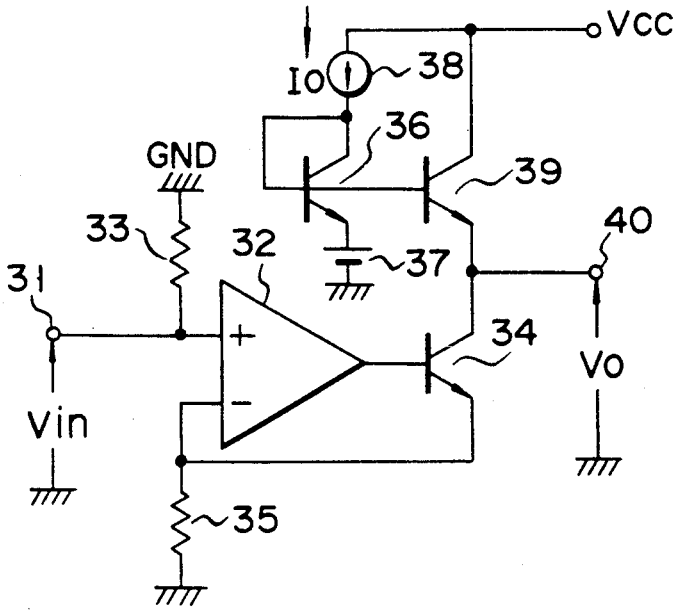
FIG. 3 is a circuit diagram of a logarithmic amplifier according to a first embodiment.

Referring now to FIG. 3, which illustrates a logarithmic amplifier according to a first embodiment of the present invention, an input signal terminal 31 is connected to the noninverting (in-phase) input terminal of a differential amplifier 32. The noninverting input terminal of the differential amplifier 32 is connected to ground potential GND through a resistor 33 adapted for setting of an input impedance. An output terminal of the differential amplifier 32 is connected to the base of an NPN transistor 34 which has its emitter connected to the inverting (opposite phase) input terminal of the differential amplifier 32. The inverting input terminal of the differential amplifier 32 is connected to ground potential through a resistor 35.

A NPN transistor 36 has its collector and base connected together. The emitter of the transistor 36 is connected to a voltage source 37 of a reference voltage of VREF. Between a supply voltage VCC and the collector of the transistor 36 is connected a current source 38 of a constant current of Io. To the supply voltage VCC is connected the collector of the NPN transistor 39. The transistor 39 has its base connected to the base of the transistor 36 and its emitter connected to the collector of the transistor 34. A connection point between the collector of the transistor 34 and the emitter of the transistor 39 is connected to an output signal terminal 40. Note that the whole circuit is formed within an integrated circuit.

Next, the operation of the logarithmic amplifier described above will be explained. An input voltage Vin referred to ground potential GND is applied to the input signal terminal 31. The differential amplifier 32, the transistor 34 and the resistor 35 constitute a feedback type of buffer amplifier which converts the input voltage Vin to a current. That is, by the feedback action of the differential amplifier 32 the same voltage as the input voltage Vin appears at the inverting input of the differential amplifier 32 and the input voltage Vin is converted to a current of Vin/R1 (R1 = resistance of the resistor 35) which forms the emitter current of the transistor 34. In general, the input impedance of the differential amplifier 32 is sufficiently large. Thus, the resistance of the resistor 33 is the input impedance which is seen by the signal input terminal 31.

Assuming here that the common-base current amplification factor $\alpha$ of the transistor 34 is sufficiently large, the emitter current of the transistor 34 becomes equivalent to the emitter current of the transistor 39. The transistor 36 is supplied with the constant current Io from the constant current source 38. Assuming that the saturation current Is1 of the transistor 36 is equal to the saturation current Is2 of the transistor 39 and taking the base-to-emitter voltage of the transistor 36 to be VBE11 and the base-to-emitter voltage of the transistor 39 to be VBE12, the output voltage Vo is given by $$\begin{aligned} Vo &= VREF + VBE11 - VBE12 \qquad (3) \\ &= VREF + \frac{kT}{q} \cdot \ln\left(\frac{Io}{Is1}\right) - \frac{kT}{q} \cdot \ln\left(\frac{Vin}{Is2 \cdot R1}\right) \\ &= VREF - \frac{kT}{q}(\ln Vin - \ln R1 - \ln Io) \end{aligned}$$

The first term of equation (3) is the reference voltage VREF which can be level-shifted freely. As a result, the level shift of the output voltage Vo can be performed freely by changing the reference voltage VREF. If the transistors 36 and 39 are formed to match each other in operating characteristics, then the transistor saturation current dependence of the output voltage Vo will be eliminated. Since the second term in (lnVin − lnR1 − lnIo) in equation (3) corresponds to the value of the resistor 35 and the third term corresponds to the value of the constant current source 38, the temperature characteristics of the output voltage Vo is substantially determined by the coefficient kT/q.

Figure 4:
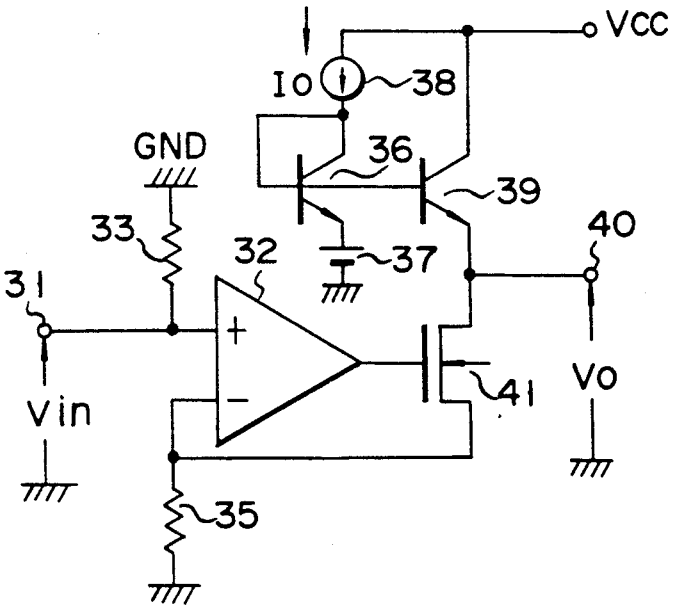
FIG. 4 is a circuit diagram of a logarithmic amplifier according to a second embodiment.

FIG. 4 illustrates an arrangement of a second embodiment of the present invention. In the embodiment of FIG. 3, the buffer circuit comprised of the differential amplifier 32, the NPN transistor 34 and the resistor 35 is used for current conversion of the input voltage Vin, whereas, in the second embodiment, the buffer circuit comprised of the differential amplifier 32, an N-channel MOS transistor 41 and the resistor 35 performs the voltage-to-current conversion. That is, the gate of the N-channel MOS transistor 40 is connected to the output of the differential amplifier 32. The MOS transistor 40 has its source connected to the inverting input terminal of the differential amplifier 32 and its drain connected to the emitter of the transistor 39.

Figure 5:
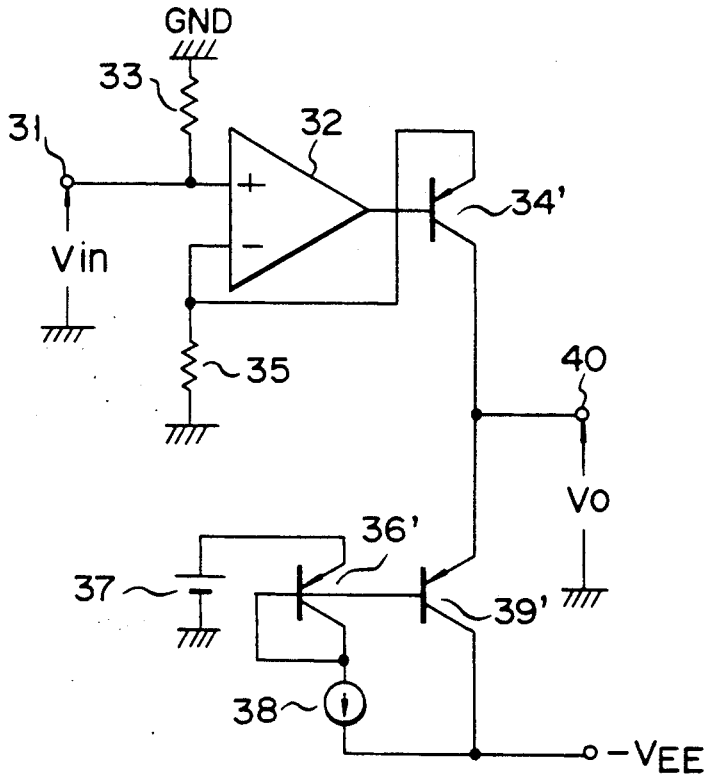
FIG. 5 is a circuit diagram of a logarithmic amplifier according to a third embodiment.

FIG. 5 illustrates an arrangement of a third embodiment of the present invention. In the third embodiment, the NPN transistors 34, 36 and 39 in the embodiment of FIG. 3 are replaced by PNP transistors 34', 36' and 39', respectively. That is, the PNP transistor 34' has its base connected to the output terminal of the differential amplifier 32, its emitter connected to the inverting input terminal of the differential amplifier 32 and its collector connected to the signal output terminal 40. The transistor 36' whose base and collector are connected together has its emitter connected to the reference voltage source 37. The constant current source 38 is connected between a negative supply voltage −VEE and the collector of the transistor 36'. The collector of the transistor 39' is connected to the supply voltage −VEE. The transistor 39' has its base connected to the base of the transistor 36' and its emitter connected to the collector of the transistor 34'.

The output voltage Vo of the circuit of the third embodiment is given by $$\begin{aligned} Vo &= VREF - VBE11 + VBE12 \\ &= VREF - \frac{kT}{q} \cdot \ln\left(\frac{Io}{Is1}\right) + \frac{kT}{q} \cdot \ln\left(\frac{Vin}{Is2 \cdot R1}\right) \\ &= VREF - \frac{kT}{q}(\ln Io - \ln Vin + \ln R1) \end{aligned} \quad (4)$$

Figure 6:
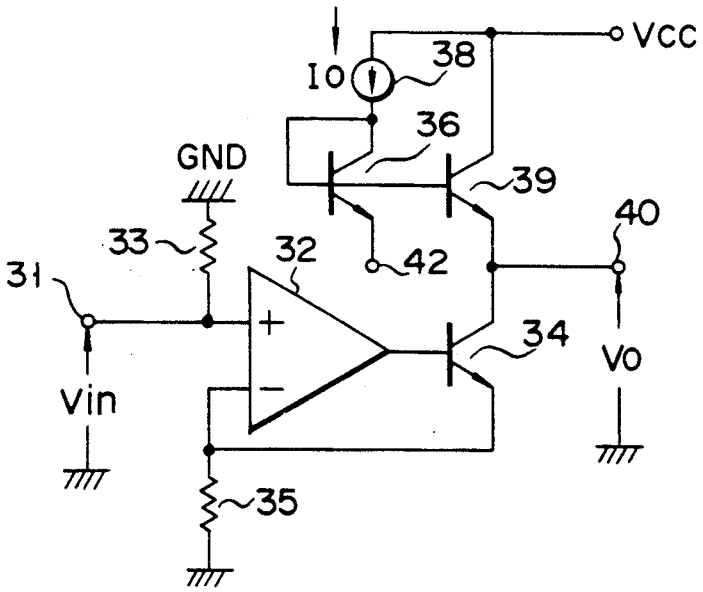
FIG. 6 is a circuit diagram of a logarithmic amplifier according to a fourth embodiment.

FIG. 6 illustrates an arrangement according to a fourth embodiment of the present invention. In the circuit of the first embodiment of FIG. 3, the reference voltage source 37 is formed within an integrated circuit, whereas, in the present embodiment, an external voltage input terminal 42 is connected to the emitter of the transistor 36 instead of integrating the reference voltage source 37 so that a reference voltage is applied to the circuit from the outside of the integrated circuit.

Figure 7:
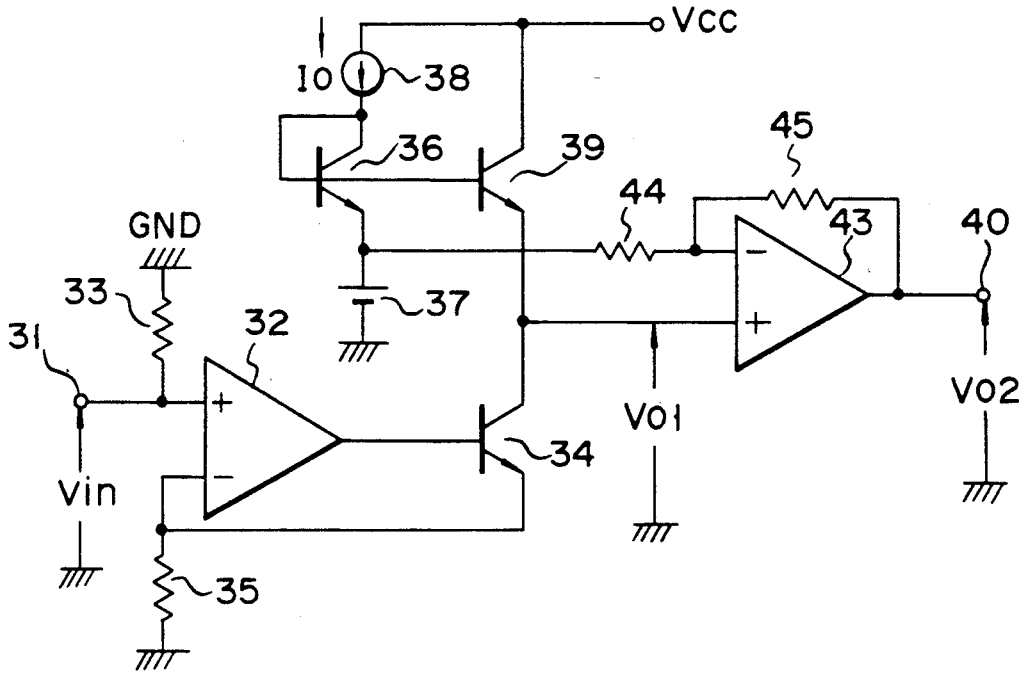
FIG. 7 is a circuit diagram of a logarithmic amplifier according to a fifth embodiment.
Figure 8:
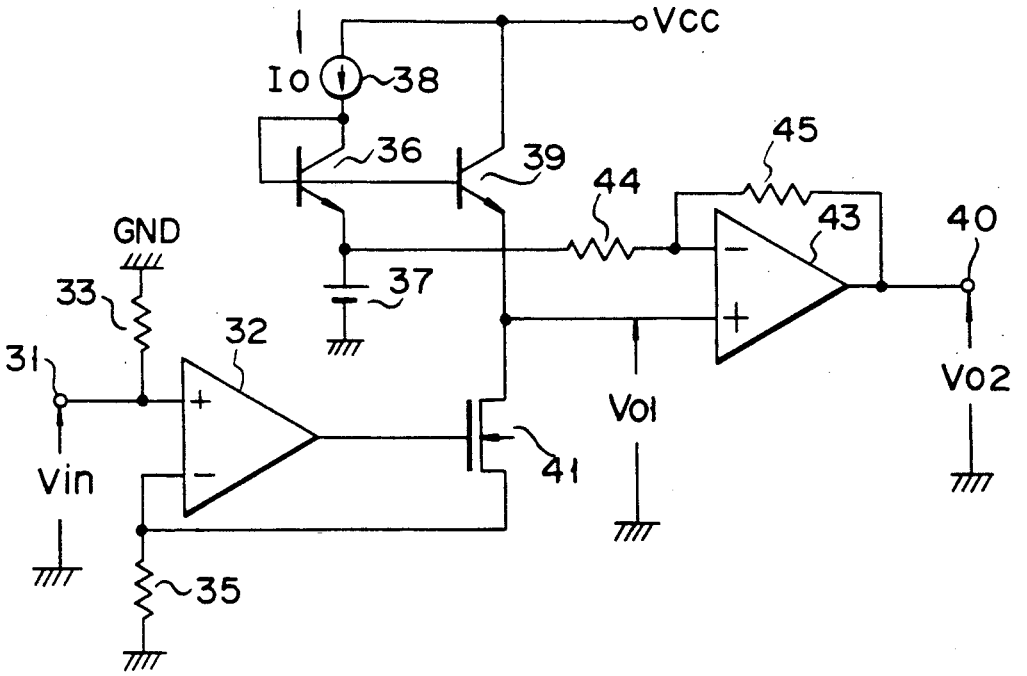
FIG. 8 is a circuit diagram of a logarithmic amplifier according to a sixth embodiment.

FIG. 7 illustrates an arrangement according to a fifth embodiment of the present invention. In the fifth embodiment, an amplifier comprised of a differential amplifier 43 and resistors 44 and 45 is additionally connected between the emitters of the transistors 36, 39 and the output signal terminal 40 of the circuit of FIG. 3. Other portions of the circuit of FIG. 7 are the same as those of the circuit of the first embodiment and thus they are designated by like reference characters. The emitter of the transistor 39 is connected to the noninverting input terminal of the differential amplifier 43. The emitter of the transistor 36 is connected to the inverting input terminal of the differential amplifier 43 through the resistor 44. The resistor 45 is connected between the output terminal of the differential amplifier 43 and inverting input terminal of the differential amplifier 43. In third embodiment, other portions than the resistor 45 are formed in an integrated circuit and the resistor 45 is externally connected to the integrated circuit.

In the logarithmic amplifier of FIG. 7, the same voltage as the input voltage (the above output voltage Vol) at the noninverting input terminal of the differential amplifier 43 is produced at its inverting input terminal by means of the feedback action of the differential amplifier. Therefore, the output voltage Vo2 of the differential amplifier 43 is given by $$\begin{aligned} Vo2 &= VREF + \frac{R2 + R3}{R2}(Vo1 - VREF) \\ &= VREF + \frac{R2 + R3}{R2}\left\{-\frac{kT}{q}(\ln Vin - \ln R1 - \ln Io)\right\} \\ &= VREF - \frac{R2 + R3}{R2} \cdot \frac{kT}{q}(\ln Vin - \ln R1 - \ln Io) \end{aligned} \quad (5)$$

In equation (5), the second term of equation (3) is multiplied by the ratio of the resistor 44 to the resistor 45, i.e., R3/R2. In addition to the advantage of the first embodiment, the present embodiment will provide an advantage that the temperature dependence due to the coefficient kT/q can be canceled out by the use of resistors with different temperature coefficients for the resistors 44 and 45. That is, since the temperature coefficient of the coefficient kT/q is about +3300 ppm/°C., it is required only that the temperature coefficient of (R2+R3)/R2 will be set to about −3300 ppm/°C.

According to the present invention, as described above, a logarithmic amplifier can be provided which can realize a level shift function with a simple direct-current coupled circuit without necessitating any large capacitance and resistance, can obtain an output voltage which is free from transistor saturation current dependence and has improved temperature characteristics, and permits a free choice and a high-resistance version of an input resistance.

Also, according to the present invention, by using two resistors with different temperature coefficients, for example, one within an integrated circuit and the other external to the integrated circuit, a logarithmic amplifier adapted for integrated-circuit version can be provided which is completely temperature compensated and permits free level shift.

What is claimed is:

1. A logarithmic amplifier comprising:

a signal input terminal;

a signal output terminal;

a differential amplifier having an inverting input terminal, a noninverting input terminal and an output terminal, said noninverting input terminal being connected to said signal input terminal;

a first resistor connected between said noninverting input terminal of said differential amplifier and ground;

a second resistor connected between said inverting input terminal of said differential amplifier and ground;

a first transistor having a control electrode and a current path, said control electrode being connected to said output terminal of said differential amplifier, one end of said current path being connected to said inverting input terminal of said differential amplifier and the other end of said current path being connected to said signal output terminal;

a second transistor having a collector, an emitter and a base, said collector being shunted to said base;

a reference voltage source connected to said emitter of said second transistor;

a constant current source connected to said collector of said second transistor; and a third transistor having its collector connected to a supply voltage, its base connected to said base of said second transistor and its emitter connected to said signal output terminal, said third transistor being of the same polarity as said second transistor.

2. A logarithmic amplifier according to claim 1, in which said first transistor is a bipolar transistor having a base, an emitter and a collector, said base being connected to said output terminal of said differential amplifier, said emitter being connected to said inverting input terminal of said differential amplifier and said collector being connected to said signal output terminal.

3. A logarithmic amplifier according to claim 1, in which said first transistor is a MOS transistor having a gate, a drain and a source, said gate being connected to said output terminal of said differential amplifier, said source being connected to said inverting input terminal of said differential amplifier and said drain being connected to said signal output terminal.

4. A logarithmic amplifier according to claim 1, in which each of said first, second and third transistors is an NPN type bipolar transistor.

5. A logarithmic amplifier comprising:

a signal input terminal;

a signal output terminal;

a first differential amplifier having an inverting input terminal, a noninverting input terminal and an output terminal, said noninverting input terminal being connected to said signal input terminal;

a first resistor connected between said noninverting input terminal of said differential amplifier and ground;

a second resistor connected between said inverting input terminal of said differential amplifier and ground;

a first transistor having a control electrode and a current path, said control electrode being connected to said output terminal of said differential amplifier, one end of said current path being connected to said inverting input terminal of said differential amplifier;

a second transistor having a collector, an emitter and a base, said collector being shunted to said base;

a reference voltage source connected to said emitter of said second transistor;

a constant current source connected to said collector of said second transistor;

a third transistor having its collector connected to a supply voltage, its base connected to said base of said second transistor and its emitter connected to the other end of said current path of said first transistor, said third transistor being of the same polarity as said second transistor;

a second differential amplifier having an inverting input terminal, a noninverting input terminal and an output terminal, said noninverting input terminal of said second differential amplifier being connected to the other end of said current path of said first transistor and emitter of said third transistor, and said output terminal of said second differential amplifier being connected to said signal output terminal;

a third resistor connected between said emitter of said second transistor and said inverting input terminal of said second differential amplifier; and a fourth resistor connected between said inverting input terminal and said output terminal both of said second differential amplifier.

6. A logarithmic amplifier according to claim 5, in which said first transistor is a bipolar transistor having a base, an emitter and a collector, said base being connected to said output terminal of said first differential amplifier, said emitter being connected to said inverting input terminal of said first differential amplifier and said collector being connected to said emitter of said third transistor.

7. A logarithmic amplifier according to claim 5, in which said first transistor is a MOS transistor having a gate, a drain and a source, said gate being connected to said output terminal of said first differential amplifier, said source being connected to said inverting input terminal of said first differential amplifier and said drain being connected to said emitter of said third transistor.

8. A logarithmic amplifier according to claim 5, in which each of said first, second and third transistors is an NPN type bipolar transistor.

9. A logarithmic amplifier according to claim 5, in which said third and fourth resistors have different temperature coefficients.

10. A logarithmic amplifier according to claim 5, in which said third and fourth resistors have different temperature coefficients which are complementary to a temperature coefficient of $kT/q$ where $k$ stands for Boltzmann constant, $T$ stands for absolute temperature and $q$ stands for electronic charge.

11. A logarithmic amplifier comprising:

a signal input terminal;

a signal output terminal;

a differential amplifier having an inverting input terminal, a noninverting input terminal and an output terminal, said noninverting input terminal being connected to said signal input terminal;

a first resistor connected between said noninverting input terminal of said differential amplifier and ground;

a second resistor connected between said inverting input terminal of said differential amplifier and ground;

a first transistor having its base connected to said output terminal of said differential amplifier, its emitter connected to said inverting input terminal of said differential amplifier and its collector connected to said signal output terminal;

a second transistor having a collector, an emitter and a base, said collector being shunted to said base;

a constant voltage input terminal connected to said emitter of said second transistor;

a constant current source connected to said collector of said second transistor; and a third transistor having its collector connected to a supply voltage, its base connected to said base of said second transistor and its emitter connected to said signal output terminal, said third transistor being of the same polarity as said second transistor.

* * * * *